US005264758A

United States Patent [19]

Iijima et al.

[11] Patent Number: 5,264,758

[45] Date of Patent: Nov. 23, 1993

[54] PLASMA DISPLAY PANEL AND METHOD OF PRODUCING THE SAME

[75] Inventors: Motoki Iijima, Ichinomiya; Akira Kani, Inuyama; Sumihito Sagou, Toyoake; Tatsumasa Yokoi, Amagun; Magonori Kamiya, Toyota; Hideyuki Asai, Aichi; Shinji Senda, Nishikamo; Naoya Kikuchi, Nishikamo, all of Japan

[73] Assignee: Noritake Co., Limited, Aichi, Japan

[21] Appl. No.: 690,924

[22] PCT Filed: Oct. 17, 1990

[86] PCT No.: PCT/JP90/01338

§ 371 Date: Jun. 14, 1991

§ 102(e) Date: Jun. 14, 1991

[87] PCT Pub. No.: WO91/06115

PCT Pub. Date: May 2, 1991

[30] Foreign Application Priority Data

| | | | |
|---|---|---|---|
| Oct. 18, 1989 | [JP] | Japan | 1-269153 |
| Nov. 9, 1989 | [JP] | Japan | 1-290027 |
| Feb. 7, 1990 | [JP] | Japan | 2-25981 |
| Feb. 8, 1990 | [JP] | Japan | 2-27193 |
| May 11, 1990 | [JP] | Japan | 2-120048 |
| Sep. 19, 1990 | [JP] | Japan | 2-247433 |
| Oct. 11, 1990 | [JP] | Japan | 2-270610 |

[51] Int. Cl.[5] ..... H01J 17/49

[52] U.S. Cl. ..... 313/584; 313/491; 313/518; 313/519; 313/585; 313/586

[58] Field of Search ..... 313/584, 518, 519, 586, 313/491, 587, 585

[56] References Cited

U.S. PATENT DOCUMENTS

| | | | |
|---|---|---|---|
| 3,798,482 | 3/1974 | Reboul | 313/587 |
| 3,842,308 | 10/1974 | Van Esdonk et al. | 313/584 |
| 4,037,130 | 7/1977 | Mimitsuka et al. | 313/587 |
| 4,352,040 | 9/1982 | Andreadakis | 313/584 |
| 4,388,550 | 6/1983 | de Vries | 313/584 X |

FOREIGN PATENT DOCUMENTS

| | | |
|---|---|---|
| 0051538 | 12/1978 | Japan . |
| 0028252 | 2/1980 | Japan . |
| 0006622 | 2/1981 | Japan . |
| 0014020 | 3/1983 | Japan . |

*Primary Examiner*—Donald J. Tusko
*Assistant Examiner*—Ashok Patel
*Attorney, Agent, or Firm*—Bucknam and Archer

[57] ABSTRACT

A plasma display panel which uses a porous metal plate having a thickness of 0.01 to 1.0 mm as a spacer and/or a discharge diaphragm, and has an insulating layer that electrically insulates said porous metal plate from the discharge electrodes, and a method for the production of the same.

7 Claims, 9 Drawing Sheets

PLASMA DISPLAY PANEL AND METHOD OF PRODUCING THE SAME

TECHNICAL FIELD

The present invention relates to a plasma display panel which uses a metal plate with apertures as a diaphragm or a spacer and to the method of producing the same.

BACKGROUND ART

In the modern plasma display panels (hereinafter referred to as PDPS), those of the type in which two pieces of substrates are laminated one upon the other maintaining a suitable gap, the periphery thereof is sealed with glass to constitute a housing and the gap is filled with a gas so that the panel is flat. Of the two pieces of substrates, the front plate must be composed of a glass plate and the other back plate is also composed of a glass plate of the same kind since it is inexpensive. Therefore, the following description deals with the PDP of this type.

In producing the PDPS, the air is exhausted prior to filling with a gas causing the pressure differential to become the greatest between the inside and the outside of the housing. Due to this pressure differential, the two pieces of glass substrates undergo a deformation. The deformation further increases due to the heating that is effected to release the gas that is adsorbed in the housing. In order to suppress the deformation to a negligible degree, the thickness of the glass plates must be increased or the size of the panel must be decreased. Such a limitation can be removed if spacers are provided between the two pieces of glass plates; i.e., spacers are indispensable for large display panels.

In the PDPs in which a plurality of discharge cells are arranged, furthermore, diaphragms or spacers are usually necessary to maintain a suitable gap for electric discharge or to prevent crosstalk relative to the neighboring cells irrespective of the type of electric discharge such as the AC type or the DC type.

Here, the arrangement of discharge cells in the PDP is determined depending upon the object of its use, and examples include a figure-eight display consisting of seven segments, a character display consisting of 5×7 dots, a full-dot display consisting of 640×480 dots, and the like.

FIGS. 1 to 5 illustrate arrangements of discharge cells in the PDPs, and wherein reference numeral 1 denotes a front glass plate, 3 denotes a diaphragm, 5 denotes a back glass plate, 6 denotes positive electrodes, and reference numeral 7 denotes negative electrodes. As shown in these drawings, there are used diaphragms and spacers (hereinafter often referred to simply as diaphragms) having a variety of shapes and cell holes of a variety of arrangements. The diaphragm can be prepared by the same method for any arrangement of cells, and a variety of methods have heretofore been attempted such as:

Method A: Thick-film method (multi-layer printing by screen printing),

Method B: Etching of photosensitive sheet glass, and

Method C: Machining of sheet glass.

Among them, the method A is excellent in regard to economy and mass-produceability but has a defect in that a gap large enough for electric discharge is not obtained unless the printing is repeated many times. In the full-dot display PDP, in particular, making the dot pitch very fine (e.g., 0.2 mm of dot pitch) is very important but cannot be accomplished by the screen-printing method. A fine dot pitch was accomplished in the shape of stripes as shown in FIG. 2 (Y. Amano: SID Int. Symp. Dig. Tech. Paper, p. 160, 1982), which, however, cannot be applied to diaphragms that completely surround the discharge cells as shown in FIGS. 1 and 4, and is not practical since it requires a very high degree of technology.

There is a great difference in sense between the case where the discharge cells are completely surrounded by the diaphragm (hereinafter referred to as the completely closed diaphragm) as described above and the case where the diaphragm does not exist relative to the neighboring cells even in one direction (hereinafter referred to as incompletely closed diaphragm) like that of the shape of stripes.

For instance, when a luminous color of a rare gas itself is to be utilized such as a PDP of an orange luminous color by the electric discharge of a neon gas, even the incompletely closed diaphragm can be put into practical use since the emission of light is limited to the proximity of electrodes of the selected cell. As the gap among the light-emitting cells becomes small, however, the electric discharge tends to take place among the neighboring cells. In the case of a multi-color or a full-color PDP, furthermore, the light is emitted by exciting the fluorescent material using ultraviolet rays produced by the electric discharge. When the incompletely closed diaphragm is used, therefore, the ultraviolet rays leak causing the fluorescent material of the neighboring cells to be excited and resulting in the emission of light. That is, the crosstalk or the color blurring develops inevitably to impair the color reproduceability and resolution, and the display panel loses its value. In regard to these points, therefore, the method A is not suited for preparing a highly fine and completely closed diaphragm, and is no practical for realizing the color PDP.

It is considered that the method B makes it relatively easy to accomplish the display panel maintaining high accuracy using, however, a very special photosensitive glass having the disadvantage of cost and economy. Moreover, fabricating a glass sheet which is as thin as 0.1 to 0.5 mm is not practical since the glass becomes brittle.

In the case of the method C, difficulty is involved in machining highly fine cell pitches and difficulty is involved, too, in the assembling operation, though there can be used a general glass.

So far, therefore, there has not yet been provided a diaphragm or a spacer that can meet the production of PDPs maintaining high accuracy, that can maintain a suitable space for electric discharge, and that can be mass-produced relatively cheaply.

The present invention was achieved in view of the above-mentioned problems inherent in the prior art, and its object is to provide a PDP which satisfies the demand for high accuracy and which is excellent in economy and mass-produceability.

DESCRIPTION OF THE INVENTION

The above-mentioned object of the present invention is achieved by using a metal plate with apertures as a diaphragm or a spacer, and by providing an insulating layer between said metal plate and the electrodes.

According to the PDP of the present invention, a porous metal plate having a thickness of 0.01 to 1.0 mm is used as a diaphragm or a spacer, and an insulating layer is provided to electrically insulate the porous metal plate from the discharge electrodes on a front plate and/or a back plate.

BEST MODE FOR CARRYING OUT THE INVENTION

Figure 6:
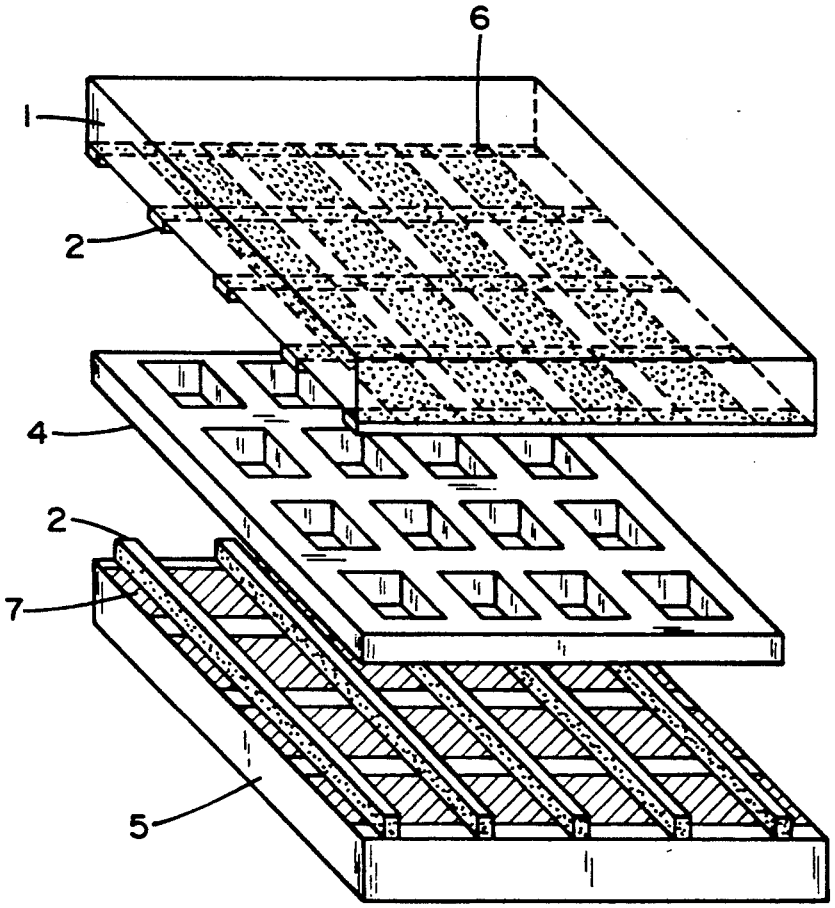
FIG. 6 is a diagram showing parts for constituting a PDP of the DC type according to an embodiment of the present invention under the condition where the parts are being assembled.

FIG. 6 is a diagram showing parts for constituting the PDP of the DC type according to an embodiment of the present invention under the condition where the parts are being assembled.

In FIG. 6, positive electrodes 6 are provided on a front glass plate 1 and negative electrodes 7 are provided on a back glass plate 5. Furthermore, a lattice type diaphragm 4 consisting of a metal plate diaphragm 4 consisting of a metal plate with apertures for discharge arranged between the front glass plate 1 and the late 5, and insulating layers 2 are positioned between the front glass plate 1, the back glass plate 5 and the lattice type diaphragm 4 in order to electrically insulate the diaphragm 4 with apertures of the lattice type from the positive electrodes 6 and the negative electrodes 7.

Figure 7:
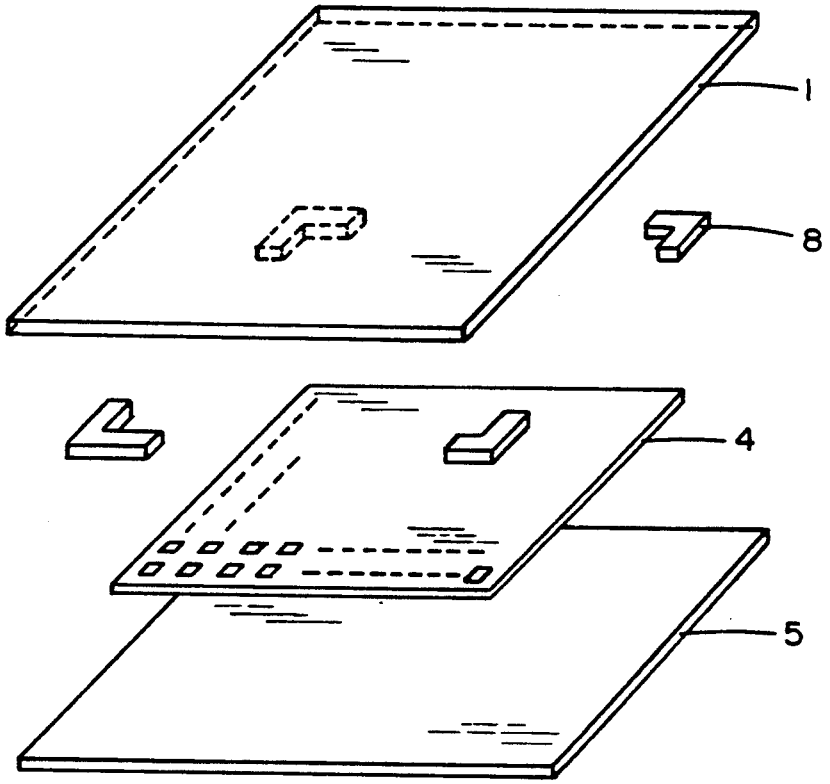
FIG. 7 is a diagram showing parts for constituting the PDP of the DC type according to another embodiment of the present invention under the condition where the parts are being assembled.
Figure 8:
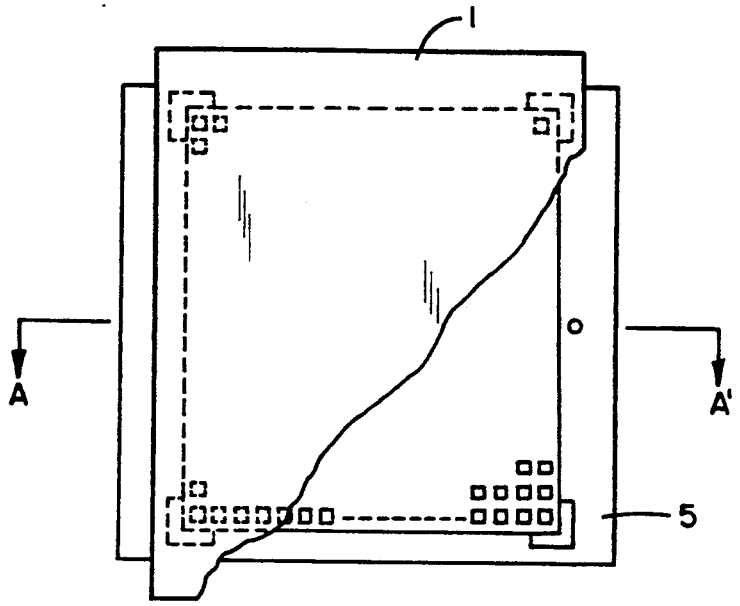
FIG. 8 is a plan view after the PDP is assembled.
Figure 9:
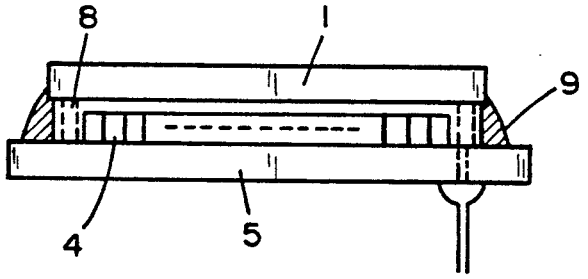
FIG. 9 is a vertical section view of the case when a cellular space is cut by the A—A' cross section of FIG. 8.
Figure 10:
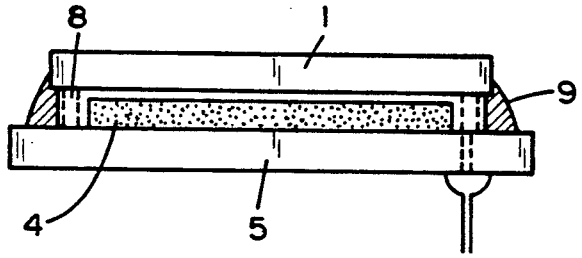
FIG. 10 is a vertical section view of the case when the diaphragm is cut by the A—A' cross section of FIG. 8.

FIG. 7 shows parts for constituting the PDP of the DC type according to another embodiment of the present invention under the condition where the parts are being assembled, FIG. 8 is a plan view after the parts are assembled, FIG. 9 is a vertical section view of when a cellular space is cut along the A—A' cross section of FIG. 8, and FIG. 10 is a vertical section view of the case when the diaphragm is cut along the A—A' cross section of FIG. 8. In FIGS. 7 to 10, reference numerals denote the same portions as those of FIG. 6. Here, however, the lattice type diaphragm 4 consisting of the metal has a dielectric layer that is deposited thereon to form an insulating layer. Reference numeral 8 denotes spacers, and 9 denotes a sealing glass.

In the present invention, the metal plate that serves as a diaphragm or a spacer is composed of an alloy that contains at least one kind of element selected from iron, cobalt, nickel or chromium, and should preferably have a coefficient of linear thermal expansion of 40 to $100\times10^{-7}$/° C. (at 250° to 5000° C.). The metal plate that is used has a thickness of 0.01 to 1.0 mm, and preferably 0.05 to 0.1 mm.

Here, the periphery of the diaphragm or the space that is sandwiched by two sheets of glass plates is sealed with glass to place a gas therein. Therefore, the diaphragm (spacer), two sheets of glass plates, and the sealing glass must have coefficients of linear thermal expansion which are nearly equal or close to each other. Otherwise, the glass may be broken due to an excess stress when cooled after the sealing.

When the two pieces of glass plates are composed of a soft glass, in general, the metal plate should desirably have a coefficient of linear thermal expansion of 80 to $100\times10^{-7}$/° C. (at 250° to 500° C.). Examples of the metal materials that are suitable may include a 42wt%Ni—6wt%Cr—Fe alloy, 50wt%Ni—Fe alloy, and the like alloys. When the glass plates are composed of a hard glass, the metal plate should desirably have a coefficient of linear thermal expansion of 40 to $60\times10^{-7}$/° C. (at 25° to 500° C.) to meet therewith. An example of the metal material that is suitable may be a 20wt%Ni—17wt%Co—Fe alloy. When there is used a glass material having a coefficient of linear thermal expansion that is different from the above-mentioned values, the material of the diaphragm should be selected accordingly.

In selecting the metal material composition, consideration is given to the price, workability and mechanical properties in addition to the coefficient of linear thermal expansion. Here, however, what is important, too, is the heat resistance in the step of sealing. Usually, the step of sealing is carried out at 400° to 500° C., and the alloys mentioned above are sufficiently usable at this temperature. The step of sealing can be simply carried out in an open atmosphere. In this case, though the resistance of the metal material against the oxidation becomes a problem, the above-mentioned alloys are sufficiently usable. Even when there remains a problem in regard to the resistance against the oxidation, the metal material can be used by making the sealing atmosphere nonoxidizing or by forming an oxidation-resistant film by the well-known metal surface treatment.

Figure 1:
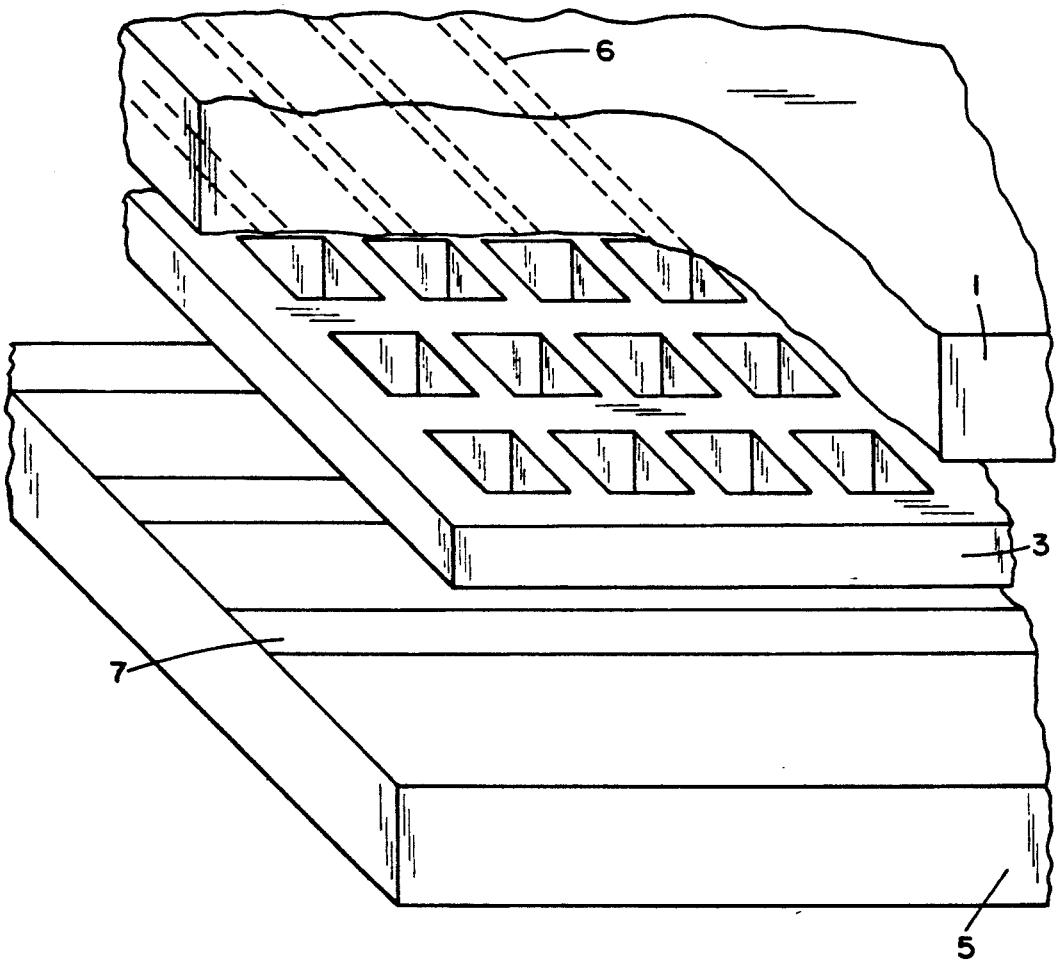
FIG. 1 PRIOR ART
FIG. 1 shows a PDP using a diaphragm having lattice type apertures in an X—Y matrix arrangement.
Figure 2:
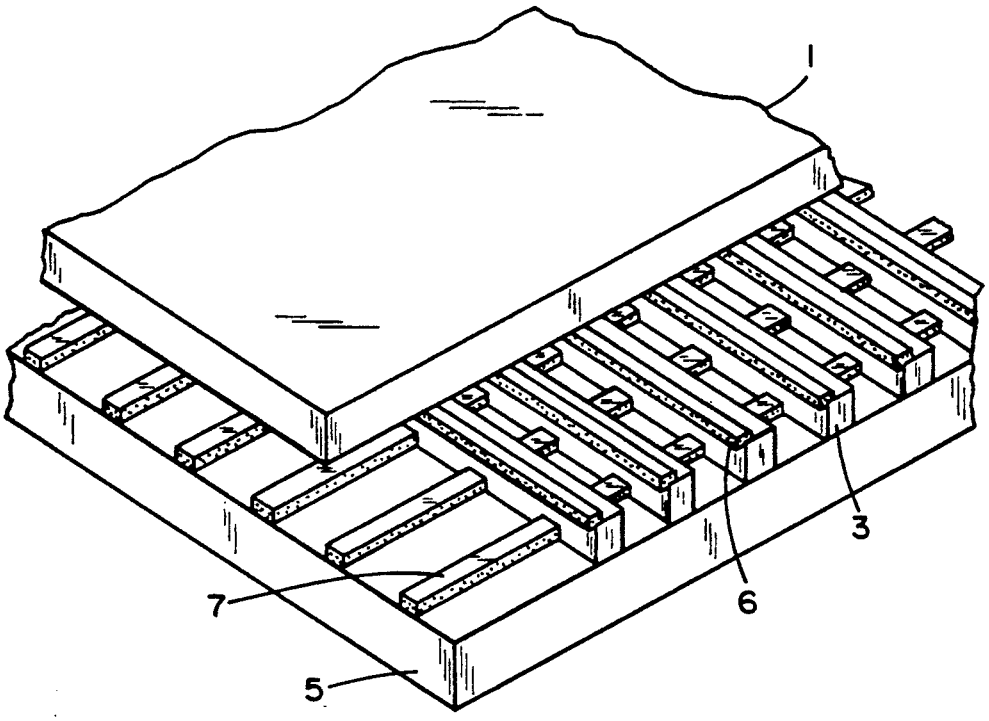
FIG. 2 PRIOR ART
FIG. 2 shows a PDP using a diaphragm having a stripe type apertures in the X—Y matrix arrangement.
Figure 3:
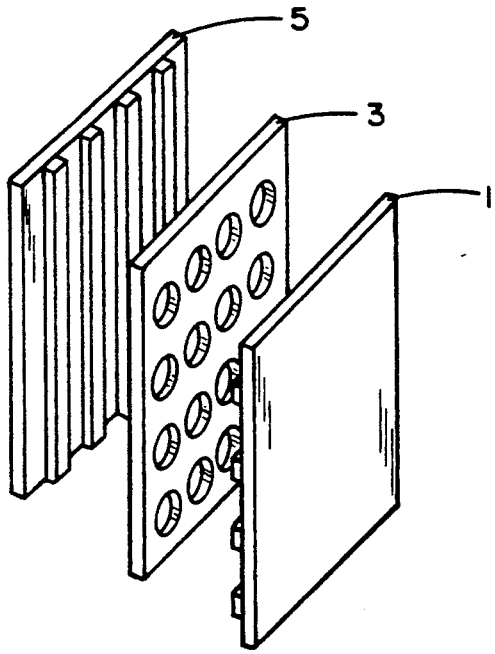
FIG. 3 PRIOR ART
FIG. 3 shows a PDP using a diaphragm having circular apertures in the X—Y matrix arrangement.
Figure 4:
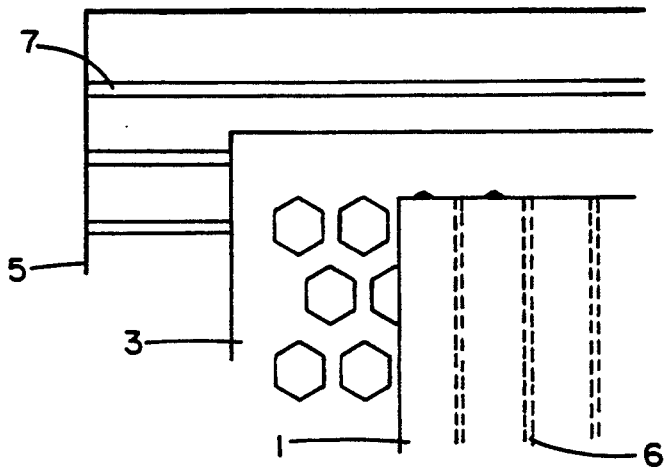
FIG. 4 PRIOR ART
FIG. 4 shows a PDP using a diaphragm having hexagonal type apertures of a delta arrangement.
Figure 5:
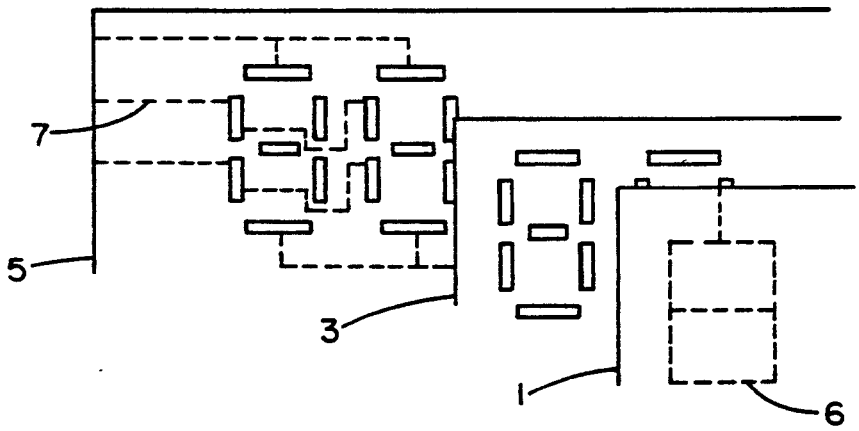
FIG. 5 PRIOR ART
FIG. 5 shows a PDP using a diaphragm having seven-segment type apertures.

A predetermined pattern a predetermined pattern with apertures for discharge is formed in the metal plate by, for example, punching using a press, laser machining, plating method, welding method, etching method or a like method. There should be used the most advantageous method by taking the machining distortion, machining precision and machining cost into consideration. Generally, however, the etching method is preferred. The apertures in the metal plate may be made in any shape and arrangement, such as in a lattice type, stripe type, circular type, delta arrangement or seven-segment type as shown in FIGS. 1 to 5. According to the present invention, however, the highly fine and completely closed diaphragms are preferred as shown in FIGS. 1 and 4 and, in particular, the lattice type shown in FIG. 1 is preferred..

In a highly fine panel having a dot pitch of smaller than 0.6 mm, the numerical aperture of the display cells becomes a problem since ineffective display portion increases due to the diaphragm. The highly fine panel usually uses the diaphragm having a height of 100 to 200 μm. In this range, there can be utilized the aforementioned realistic diaphragm-forming method, i.e., the thick-film printing method. When the height is smaller than 100 μm, the effect of cathode sputtering becomes too great in the case of the DC type, and it further becomes difficult to uniformalize the discharge characteristics over a number of cells. To make the height greater than 200 μm, the printing must be carried out an increased number of times resulting in an increase in the cost. The higher the diaphragm, the more difficult to reduce the diaphragm width that affects the numerical aperture. When the diaphragm has a height of about 100 μm, the minimum width of the diaphragm that can be formed by the thick-film printing method is about 80 μm in the case of the stripe type and about 150 μm in the case of the lattice type. In the completely closed diaphragm using the metal plate of the present invention, a minimum diaphragm width of about 20 μm is accomplished when the thickness is about 50 μm and a minimum diaphragm width of about 30 μm is accomplished when the thickness is about 100 μm by the etching method. Therefore, when compared using the completely closed diaphragm having a height of 100 μm and a square lattice with 0.6 mm of pitch, the numerical aperture becomes about 56% in the case of the thick-film printing method and about 90% in the case of a piece of metal plate, creating a difference of about 1.6 times in numerical aperture. This difference further increases with a decrease in the dot pitch. The diaphragm having a further increased numerical aperture can be formed if thin metal plates are used in combination.

The present invention makes use of the metal plate with apertures that is formed in a desired shape as a diaphragm. In this case, furthermore, the discharge electrodes have been arranged on the front plate and/or the back plate, and there will be no problem when the electrodes are covered by a dielectric member as in the PDP of the AC type. When the electrodes are exposed to the discharge space as in the PDP of the DC type, however, the metal plate (diaphragm) that is sandwiched and sealed between the front plate and the back plate comes in electric contact with the electrodes.

That is, electric short-circuiting takes place among the positive electrodes, among the negative electrodes, and among the positive and negative electrodes in the PDP, and no electric discharge takes place to emit light. According to the present invention, therefore, the above-mentioned problem is solved by providing an insulating layer between the porous metal plate (diaphragm) and the discharge electrodes.

The insulating layer may be formed on the electrodes on the front plate and on the back plate, or may be formed on the surfaces of the metal plate (diaphragm) that come in contact with the electrodes, or may be formed on both of them. Moreover, the metal plate may be provided with an insulating layer.

The insulating layer is deposited by a variety of technologies such as spray method, printing method, electrostatic coating method, dipping method, anodic oxidation method, heat oxidation method, sputtering method, melt-injection method and electrodeposition method, and any one of them can be selected by taking the cost, performance and the like into consideration. The following two methods are preferred.

That is, the first method is the electrodeposition method by which nearly the entire surface of the porous metal plate is coated with a dielectric material to form an insulating layer. The electrodeposition method is achieved by using the metal plate as an electrode, by dispersing a glass and a dielectric powder including the glass in a solution that contains an electrolyte, and by applying an electric field thereto. The particle size should desirably be form 0.1 to 5 μm though it may differ depending upon the insulating layer that is required. The dispersion solution may be an isopropyl alcohol and the electrolyte may be $Al_2(NO_3)_3$, $Ba(NO_3)_2$, which, however, can be selected from man widely known ones. The powder that is electrodeposited is heated to melt the glass, whereby the insulating layer is intimately adhered nearly on the entire surface of the porous metal plate. The insulating layer that is too thick is not desirable from the standpoint of reducing the space of the discharge cell. Usually, the insulating layer should have a thickness of from 1 to 10 μm. The metal plate that is provided with the insulating layer over nearly the entire surface maintains electric insulation relative to the discharge electrodes and further offers the following advantage. If the diaphragm is constituted by the dielectric material alone, the electrically conductive material that is sputtered by the electric discharge is deposited on the dielectric material in such small amounts that there arises no problem of short-circuiting among the electrodes. There, however, exists an increased probability of short-circuiting if the metal plate is used as a diaphragm as in the present invention and if the distance of insulation is short between the electrodes and the metal plate. According to the above-mentioned electrodeposition method, however, the diaphragm can be constituted in the same manner as the conventional one which is made of a dielectric eliminating the probability of short-circuiting.

The second method consists of transferring the insulating layer onto the surface of the porous metal plate by utilizing the pressure or both the heat and the pressure. This method has been widely known and a variety of materials can be used therein as described below. The substrate that can be peeled off is composed of a polyester film on which a silicone film is formed, and a pressure-sensitive ink or a heat- and pressure-sensitive ink is composed of kneading a vehicle obtained by dissolving an acrylic resin in a solvent such as butylearbitol acetate together with glass and a dielectric powder that contains the glass. The particle size should range from 0.1 to 5 μm. The ink is screen-printed on the substrate that can be peeled off to form an insulating layer which is then dried. The metal plate is placed on the film, the pressure is exerted upon them at ordinary temperature or under a heated condition, the insulating layer is adhered as a surface pattern onto the metal plate, and the substrate is peeled off thereby to transfer the insulating layer. The insulating layer is transferred onto one surface or both surfaces of the metal plate. The insulating layer that is transferred is then heated to melt the glass and is thus firmly adhered to the porous metal plate. If the firm adhesion is effected with the panel being in contact with the glass substrate, then the diaphragm can, at the same time, be firmly adhered onto the glass substrate.

The above-mentioned transfer method gives a great advantage for the highly fine panels and, particularly, for those panels having small diaphragm width. When the insulating layer is provided even on the side surfaces of the diaphragm as in the first method, it is allowed to reduce the area of the discharge cell even if the insulating layer has a reduced thickness. When the insulating layer is provided on the surface only of the porous metal plate, it becomes difficult to print a highly fine pattern, the size tends to be easily deviated, and the ink spreads onto the side surfaces of the diaphragm due to blurring of ink, provided the screen-printing method or a like method is used instead of the transfer method. The difficulty can be understood if a highly fine panel is presumed having a diaphragm width of smaller than 100 μm and a cell pitch of smaller than 200 μm.

When a metal that serves as the diaphragm is exposed in the space of discharge as in the second method, there may arise a problem on the discharge electrodes. In the PDP of the DC type as is well known, however, the voltage drops greatly only in the vicinity of the negative electrodes. The present inventors therefore have found through experiments that the discharge panel operates sufficiently if the vicinity only of the discharge electrodes is insulated despite there exist electrically conductive portions. it was found through experiments that there exists no problem if the distance of insulation between the electrodes and the diaphragm metal is several μm or is about 10 μm just to maintain safety. Therefore, the insulating layer should have a thickness so as to obtain such a distance.

Thus, the insulating layer (dielectric layer) formed on the metal plate has a thickness of 1 to 100 μm.

In the case of a panel consisting of a metal plate having parallel surfaces that constitute a completely closed diaphragm sandwiched by two pieces of glass plates, on the other hand, there arises a problem in regard to exhausting the gas prior to filling a discharge gas. The problem becomes conspicuous particularly when the upper and lower four peripheral sides of each discharge cell are air-tightly adhered to the panel glass substrates by, for example, melt-adhering the glass. In this case, the adhesion must be effected in the device which is filled with the gas and contrivance must be made to the device. Here, however, an ordinary device can be used if each cell has a gap that is communicated with a discharge hole. The present inventors have found through experiments that there arises no problem in placing the gas if the gap or the groove for diffusing the gas between the porous metal plate and the panel glass is several μm or is about 10 μm just to maintain safety.

In many cases, such a gap is inevitably formed by ruggedness in forming an electrode film on the panel glass or in forming an insulating layer on the panel or on the metal plate, or by ruggedness that results from the pattern. Furthermore, the grooves for diffusing the gases can be reliably formed by any one of the following methods or by a combination of the following methods. First, the thickness of the electrode film is increased by using the thick-film technology. Second, a dielectric having the shape of stripes is used as an insulating layer between the electrodes and the metal plate to impart a predetermined thickness. Third, grooves are formed in the surface of the porous metal plate. To form the grooves, it is desired to use the etching method that was described earlier in connection with forming the pattern and according to which the treatment can be effected at one time simultaneously with the formation of the porous pattern.

Figure 11:
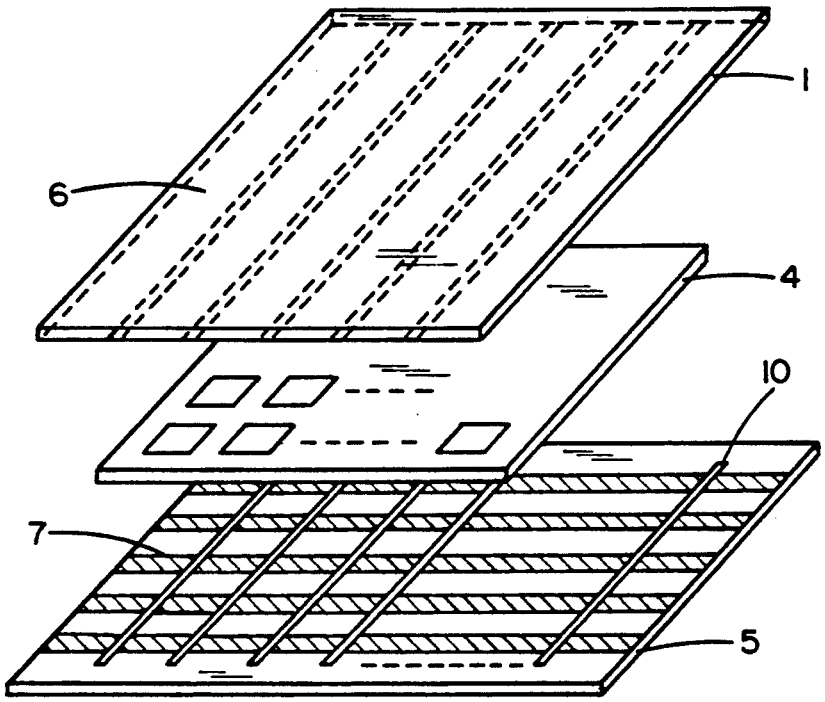
FIG. 11 is a diagram showing parts for constituting the PDP of the DC type according to a further embodiment of the present invention under the condition where the parts are being assembled.
Figure 12:
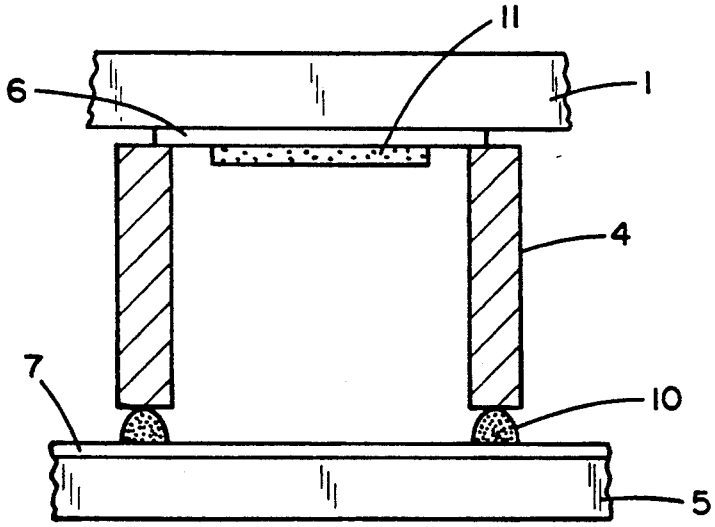
FIG. 12 is a section view showing the structure of a cell of the PDP of FIG. 11.

FIG. 11 shows the parts constituting the PDP of the DC type under the condition where the parts are being assembled using the stripe type dielectric as in the aforementioned second method, and FIG. 12 is a section view showing the structure of a cell of the PDP. In FIGS. 11 and 12, reference numerals denote the same members as those of FIG. 6. Here, however, a dielectric layer is deposited on the lattice type diaphragm 4 which consists of a metal plate to form an insulating layer just like in FIG. 7. Reference numeral 10 denotes a stripe type dielectric, and 11 denotes a fluorescent material. The dielectric material used for the insulating layer consists of one or more of those selected from an organic material, crystalline inorganic material and glass. Generally, furthermore, a glass or a crystalline inorganic material containing the glass is used.

Concrete examples of the glass composition include $PbO-B_2O_3-SiO_2$, $PbO-B_2O_3$, $ZnO-B_2O_3-SiO_2$, and the like. These glasses should have softening points of 350° to 1000° C. and glass particle sizes of about 1 to 5 μm. The glass used here is heated at a temperature (sealing temperature) at which the sealing glass frit is softened and melted in the step of sealing the PDP, but should not be melted again at this temperature. Usually, the sealing temperature of the glass frit is higher by about 50° C. than the softening point thereof. Further, the sealing temperature of the PDP should be about 400° to 450° C. and, hence, the glass contained in the dielectric should have softening point which is higher than 350° C.

Further, since the dielectric is formed on the surface of the metal plate, the upper limit of the softening point is so determined that the metal will not undergo deformation and that the metal and the dielectric will not undergo the chemical reaction in large amounts, and should desirably be lower than 1000° C.

Further, examples of the crystalline inorganic material include ceramics such as alumina ($Al_2O_3$), forsterite ($2MgO-SiO_2$) and the like, as well as inorganic pigments ($FeO-Cr_2O_3$, $CoO-Al_2O_3$, etc.). The crystalline inorganic materials should have particle sizes of about 1 to 5 μm.

Furthermore, any organic material can be used provided it can finally turned into an inorganic material.

In a general panel-sealing method (sealed with a sealing glass), the insulating layer must withstand the sealing temperature and must have a coefficient of linear thermal expansion which is nearly the same as those of the two pieces of glass plates, sealing glass and diaphragm. From such points of view, the above-mentioned materials are suitably selected.

Furthermore, the metal plate that has electric conductivity can be used as an electrode. This electrode is electrically coupled among a number of cells and is not advantageous for being used as an electrode for selecting the display cells. In the PDP of the DC type, however, it has been proposed to employ auxiliary electric discharge (Japanese Patent Laid-Open Gazette No. 115060/1979, Japanese Patent Laid-Open Gazette No. 30038/1983, journal of the Television Society, Vol. 40, No. 10, 1986, p. 953). Developing the auxiliary discharge over the whole cells simultaneously is effective, and the above porous metal plate can be used as the electrode for the auxiliary discharge.

Figure 13:
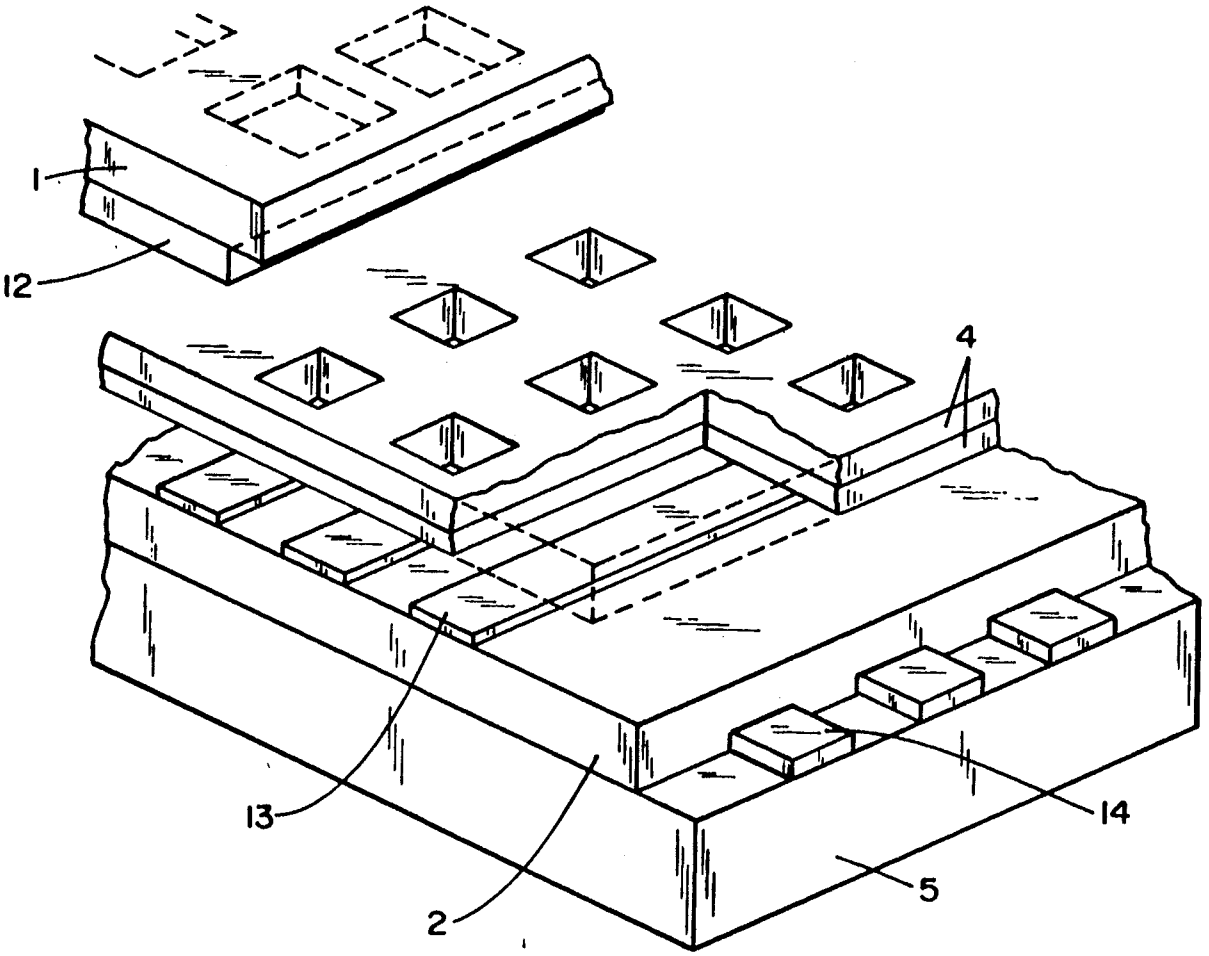
FIG. 13 is a diagram showing members for constituting the PDP of the DC type according to a still further embodiment of the present invention under the condition where the members are being assembled.
Figure 14:
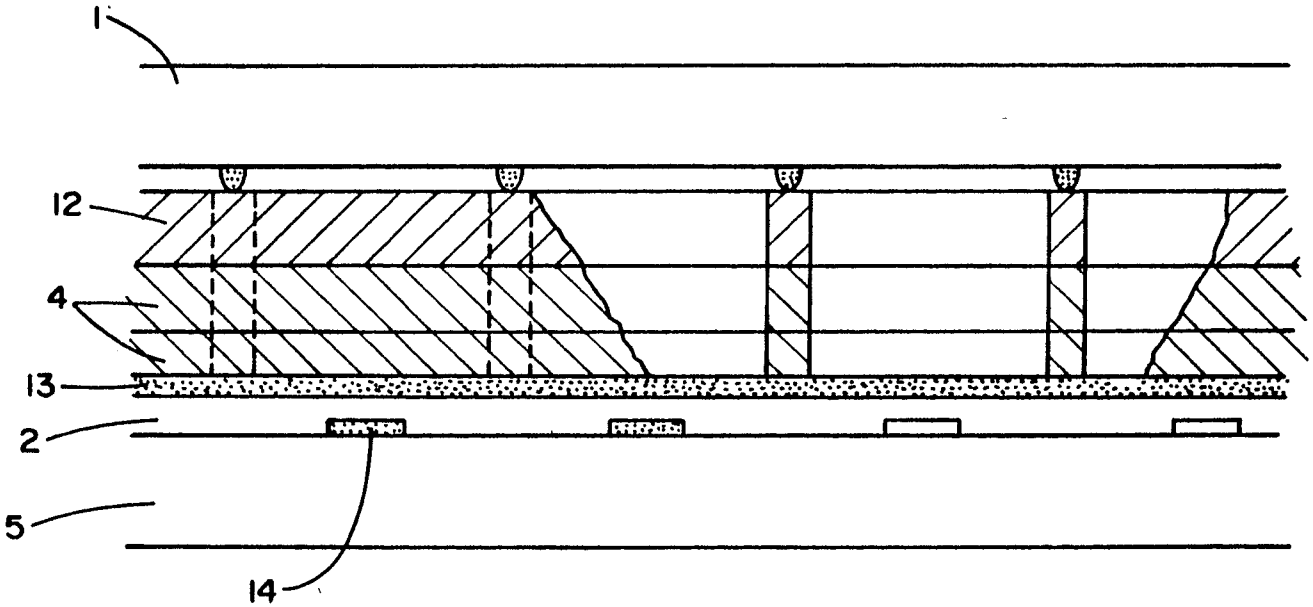
FIG. 14 is a section view of the cells along the direction of positive electrodes of the PDP of FIG. 13.

FIG. 13 shows parts for constituting the PDP in the condition where the parts are being assembled using the porous metal plate as the auxiliary discharge electrode, and FIG. 14 is a section view of the cells along the direction of the positive electrode. In FIGS. 13 and 14, reference numerals denote the same portions as those of FIG. 6. Here, however, a dielectric layer is deposited on the lattice type diaphragm 4 which consists of a metal thereby to form an insulating layer just like in FIG. 7. Further, reference numeral 12 denotes a third electrode (positive electrode), 13 denotes a group of second electrodes (negative electrodes), and 14 denotes first electrodes (trigger electrodes).

If necessary in this case, it is allowable to use a plurality of metal plates to form space for auxiliary discharge as shown in FIGS. 13 and 14. For instance, if two pieces of metal plates having nearly the same pattern are overlapped on the same position, and if one of them is used as an auxiliary discharge electrode while the other one is being used as a diaphragm for forming space for discharge, the display is not interrupted by the auxiliary discharge electrode. The same method as the one for forming the aforementioned insulating layer can be employed here if it is necessary to provide an insulation among the plurality of metal plates. The auxiliary discharge electrode can be used even under the condition where the metal is exposed as is widely known or where it is covered by a dielectric layer. Moreover, the positions are suitably designed to meet the electrode structure and shape of the panel. Use of the plurality of metal plates makes it possible to increase the degree of freedom for designing the distance among the electrodes that are opposed to each other, as well as to use thin metal plates provided the diaphragm has the same height. It is therefore allowed to form more fine cell pitches than when a piece of the porous metal plate is used. Or, if the cell pitch is the same, then there can be used the diaphragm having a small width, i.e., having a large numerical aperture.

These are accomplished only in the case of the plate being easily workable because the plate is made of metal though it is thin. These advantages can be obtained even in the following case.

That is, in the color PDP, ultraviolet rays are usually generated by the electric discharge to excite a fluorescent material and to emit light. The fluorescent material is usually deposited on the front glass plate or on the back glass plate. The brightness of the emitted light increases with an increase in the area of the fluorescent material that is deposited. It is therefore desired to deposit the fluorescent material even on the side surfaces of the diaphragm, i.e., even on the inner surfaces of the apertures of the metal plates. The same design has been proposed even for the diaphragm that is made of a conventional dielectric (Sakai: A Few Experiments of a Discharge Display Element and its Applications, Material 13-1 of the Academy of Image Display of the Television Society (March, 1975) and Japanese Patent Laid-Open Gazzete No. 38996/1976). It is difficult to handle the plate that uses glass and that has a large display area with the cell pitch of smaller than 0.6 mm. Moreover, high degree of technology is necessary to apply fluorescent materials of many colors onto the side surfaces of the diaphragm that is formed on the panel substrate by, for example, the thick-film printing method. The metal plate of the present invention can be easily handled making it possible to form a pattern maintaining high accuracy and, hence, to put the following method into practice.

The fluorescent material is usually in a powdery form from which a thick-film ink can be prepared. The fluorescent material is printed onto the portions using the ink. However, the ink often fails to reach the innermost part of the holes or clogs the holes if it reaches the innermost part. Here, if the ink is sucked from the side of the apertures opposite to the printed side, the fluorescent material is applied to the inner surfaces of the apertures maintaining a thickness depending upon the viscosity of the ink, and an excess of the ink is drained out of the holes. This method makes it possible to separately apply fluorescent materials of many colors even onto the inner surfaces of holes of the porous metal plate that has a cell pitch of smaller than 0.3 mm. The diaphragm of the present invention is realized in the completely closed type and offers a larger fluorescent material-deposited area than that of the incompletely closed diaphragm.

In forming a cell diaphragm that is used for the PDPs, the present invention uses a diaphragm made of a metal plate that is different from the customarily used dielectric (glass or inorganic material containing glass) diaphragm. Therefore, the cell shape, size and pitch of arrangement are greatly dependent upon the working precision of the thin metal plate, and sufficient precision is offered for forming dot sizes and dot pitches required by the PDPs of the AC type and the DC type that give ordinary dot matrix display. Moreover, the insulating layers electrically insulate the metal plate from the electrodes on the front plate and on the back plate.

As described above, the PDP of the present invention that uses a metal plate as the diaphragm and that has an insulating layer, is capable of realizing a highly fine cell pitch maintaining excellent crosstalk characteristics. Moreover, no electric short-circuiting takes place among the positive electrodes—negative electrodes.

PREFERRED EMBODIMENTS OF THE INVENTION

The invention will now be described in further detail by way of examples.

EXAMPLE 1

A 42wt%Ni—6wt%Cr—Fe alloy having a coefficient of linear thermal expansion of $92\times10^{-7}/°$ C. was used as a metal material composition for the metal plate that serves as a diaphragm. The metal plate possessed a thickness of 0.1 mm, the arrangement of perforation was of the lattice form with many square apertures arranged in the vertical and lateral directions maintaining an equal pitch of 0.2 mm, the size of the apertures being $0.15\times0.15$ mm, and the holes being obtained by etching to obtain the metal plate with apertures.

As shown in FIG. 6, the PDP was equipped with a transparent and electrically conductive film (ITO) that serves as positive electrode on the front glass plate and nickel that serves as negative electrodes on the back glass plate. Furthermore, a dielectric layer in the form of stripes was formed by screen-printing on the electrodes of the front glass plate and the back glass plate avoiding the display cell regions, thereby to form an insulating layer.

Next, with the metal plate (diaphragm) being sandwiched between the front plate and the back plate, the periphery was sealed with glass in order to form an X—Y matrix PDP of the DC type.

COMPARATIVE EXAMPLE 1

The diaphragm of the DC-type PDP described in Example 1 was formed by the thick film-printing method.

First, the diaphragm was prepared having a dot pitch of 1.0 mm and apertures measuring 0.8×0.8 mm. The diaphragm having a height of 0.15 mm was formed by repeating the printing eight times.

Next, it was attempted to form a diaphragm having a dot pitch of 0.2 mm and an aperture of 0.15×0.15 mm maintaining the same accuracy as that of Example 1. Deviation of alignment that could be almost neglected when the pitch was 1.0 mm was no more negligible, drooping of the printed paste was not negligible, the production was technically difficult, and the yield was very inferior to that of the Example 1. Even those that were favorably prepared did not exhibit sufficient numerical aperture of the cells because of the reasons described above. If an example is shown, the size of the apertures was 0.1×0.1 mm for the pitch of 0.2 mm and the numerical aperture was 25%. In the above-mentioned Example 1, the size of the apertures was 0.15×0.15 mm and the numerical aperture was 56% offering distinguished advantage.

COMPARATIVE EXAMPLE 2

The diaphragm of the DC-type PDP described in Example 1 was prepared by etching a photosensitive sheet glass. As mentioned earlier, however, this material is very expensive. Moreover, the sheet glass was so thin that it was very brittle and was inferior to that of the Example 1 even from the standpoint of assembling and workability.

COMPARATIVE EXAMPLE 3

The diaphragm of the DC-type PDP like that of Comparative Example 2 was prepared by perforating a general soda lime glass or a like glass. When a number of apertures were made by this method maintaining a pitch as highly fine as about 0.2 mm, however, the dimensional accuracy was considerably lower than that of Comparative Example 2. Considering from the brittleness of the thin sheet glass, furthermore, the diaphragm was inferior to that of Comparative Example 2 from the standpoint of workability and assembling, and was hence considerably inferior to that of Example 1.

COMPARATIVE EXAMPLE 4

The metal plate was used alone as a diaphragm without providing the insulating layer on the front glass plate and on the back glass plate. As a result, electrical short-circuiting took place among the positive electrodes negative electrodes, the display panel did not turn on and often short-circuiting took place among the positive electrodes or among the negative electrodes causing the nonselected cells to emit light. Thus, the porous metal plate did not work as a diaphragm for the PDP.

EXAMPLE 2

A dielectric was deposited on the lattice type metal plate that was used in Example 1 to form an insulating layer thereon.

As a dielectric material, use was made of an inorganic filler such as a $ZnO—B_2O_3—SiO_2$ type glass powder, $Al_2O_3$, $FeO{\cdot}Cr_2O_3$ or the like having a softening point of 600° C. and an average particle size of 2 to 3 μm. The dielectric was electrodeposited in an electrodepositing solution using the lattice type metal plate as a negative electrode and using a metal plate made of the same material and having nearly the same area as a positive electrode being impressed with a voltage of DC 200 volts.

The electrodeposited condition was very good and the electrodeposited layer exhibited very good strength.

The above sample was fired at a temperature higher than 600° C. which is the softening point of the glass powder to obtain a densely formed dielectric layer. Thus, there was obtained a desired lattice type metal plate on which the surfaces were deposited the dielectric.

Next, the DC-type PDP was prepared as described below using, as a diaphragm, the lattice type porous metal plate on which the surface has been deposited the dielectric.

That is, as shown in FIGS. 7 to 10, the lattice type metal plate whose surfaces have been covered with the dielectric was used as a diaphragm 4, and a glass which is thicker than the diaphragm 4 by about 30 μm was used as the spacer 8. The diaphragm 4 and the spacer 8 were sandwiched between the front glass plate 1 and the back glass plate 5, and the periphery thereof was sealed with a glass 9 to form an X—Y matrix PDP of the DC type.

The DC-type PDP was sealed well and there developed no problem such as breakage due to stress and strain. The spacer was located outside the display region of the PDP, a gas introduction space of about 30 μm always existed in the display region over the diaphragm, and the air could be exhausted and a gas could be filled reliably over the whole display region.

EXAMPLE 3

The DC-type PDP was prepared as described below by using the lattice type metal plate with apertures of the lattice type; on which the surface has been deposited the dielectric that was used in Example 2 and a stripe type dielectric.

That is, using Photoinsulator (produced by Tokyo Ohka Kogyo Co., Ltd.), the stripe type dielectric was obtained by forming a dielectric layer having a line width of 50 μm on the back glass plate maintaining a thickness of 30 μm and a pitch of 0.2 mm.

Next, as shown in FIGS. 11 and 12, the metal plate 4 with apertures of the lattice type for pressing the electron beam on which has been deposited the dielectric and the stripe type dielectric 10 were sandwiched between the front glass plate 1 and the back glass plate 5 so as to use them as a diaphragm, followed by the sealing with a low-melting glass frit. Then, the air therein was evacuated and a gas was placed therein through a chip tube which was then sealed and chipped off to prepare a PDP of the DC type. In the thus prepared DC type PDP as shown in FIGS. 11 and 12, positive electrodes 6 are provided on the front glass plate 1 and a fluorescent material 11 is applied onto the inner surface of the front glass plate 1. Further, the back glass plate 5 is provided with negative electrodes 7. The positive electrodes 6 and the negative electrodes 7 meet at right angles to form a dot matrix. Thus, there was obtained the DC-type PDP having a dot number of 100×100. The gas having a composition He-Xe(2%) was filled under 300 Torr.

The thus obtained DC type PDP was excellent with respect to adaptability toward enhancing the accuracy, workability, uniformity in the discharge voltage characteristics, and crosstalk characteristics.

EXAMPLE 4

The PDP of the DC type was prepared as described below using as a diaphragm the metal plate with apertures of the lattice type on which the surface has been deposited the dielectric that was used in Example 2.

That is, as shown in FIGS. 13 and 14, a thin aluminum film was formed into stripes maintaining a pitch of 0.2 mm a dielectric layer 2 was formed thereon by kneading a vehicle together with a powder consisting of a $ZNO—B_2O_3—SiO_2$ type glass powder and a small amount of $Al_2O_3$ to obtain a paste thereof, solid-printing the paste by the screen-printing method and firing it at 580° C. Then, second electrodes 13 were formed in a shape of stripes on the dielectric layer in a direction to meet the first electrodes 14 at right angles, based on the screen printing method using a nickel paste maintaining a pitch of 0.2 mm and a line width of 0.1 mm and firing it at 580° C.

The metal plate that serves as a third electrode 12 was made of a metal plate having the same material and the same shape as the substrate metal consisting of the metal plate that served as the diaphragm 4. Here, the diaphragm 4 consists of two pieces of metal plates.

Next, the diaphragm 4 consisting of the thus obtained metal plates was placed on the back glass plate 5, sandwiched by the front glass plate 1 that has the third electrode 12, followed by the sealing with a low-melting glass frit. Then, the air therein was evacuated and a gas was filled through a chip tube which was then cut off to obtain a PDP of the DC type. The gas having a composition Ne-Ar(0.5%) was filled under 350 Torr. The thus obtained DC-type PDP was excellent with respect to sputter resistance of the negative electrodes, current density of the negative electrodes, discharge-maintaining voltage and workability (mass-produceability).

EXAMPLE 5

A 42wt%Ni—6wt%Cr—Fe alloy having a coefficient of linear thermal expansion of $92\times10^{-7}$/° C. was used as the porous metal plate that served as the diaphragm. The metal plate possessed a thickness of 75 μm, the arrangement of perforation was of the lattice form with many square apertures arranged in the vertical and lateral directions maintaining an equal pitch of 0.2 mm, the size of the holes being $0.17\times0.17$ mm, and the number of apertures being perforated by etching to obtain a metal plate (type A). Furthermore, another similar metal plate was prepared having a thickness of 75 μm, a cell pitch of 0.15 mm, and a hole size of $0.12\times0.12$ mm (type B).

As the dielectric material, use was made of an inorganic filler such as a $ZnO—B_2O_3—SiO_2$ type glass powder, $Al_2O_3$, $Fe_2O_3{\cdot}Cr_2O_3$ or the like having a softening point of 800° C. and an average particle size of 2 to 3 μm. An acrylic resin having adhesiveness under the application of heat and pressure was dissolved in an organic solvent such as BCA (butylcarbitol acetate) or pine oil to obtain a vehicle for transfer printing. The vehicle consisted of 5 to 20 parts by weight of a resin component and 80 to 95 parts by weight of a solvent component. Then, the glass powder and the inorganic filler were kneaded in an amount of 60 to 80 parts by weight together with 20 to 40 parts by weight of the vehicle to obtain a paste for transfer printing. The paste was solid-printed by the screen-printing method on a polyester film that is a substrate that will be peeled off, and was dried to a sufficient degree at 90° C. The transfer sheet that was dried was press-adhered onto the porous metal plate using a hot roller or a hot flat press. After the press-adhesion, the transfer sheet was peeled off, the metal plate on which the dielectric layer has been formed was fired in the open air at 600° to 680° C. such that the dielectric layer became completely inorganic and dense, thereby to obtain an insulating layer on the surface of the metal plate.

Next, the PDP of the DC type was prepared as described below using the above metal plate as the diaphragm. That is, as shown in FIG. 6, the metal plate was used as the diaphragm 4 which was then sandwiched between the front glass plate I and the back glass plate 5 on which the electrodes have been formed, and the periphery thereof was sealed with a glass in order to form an X—Y matrix PDP of the DC type.

The DC type PDP was sealed well and there developed no problem such as breakage due to stress and strain.

The DC type PDP exhibited good results without decreasing the numerical aperture irrespective of either the type A or the type B having dissimilar cell pitch was used.

We claim:

1. A plasma display panel having a frame, a first group of positive electrodes and a second group of negative electrodes and comprising a front glass plate, a back plate and a diaphragm therebetween, said diaphragm having a thickness of 0.01 to 1.0 mm, said front glass plate and said back plate being sealed together, said diaphragm having an upper surface and a lower surface and consisting of a metallic sheet having a plurality of apertures for permitting discharge, wherein the electrodes in the first group and the electrodes in the second group are parallel and said first group and said second group of electrodes intersect with each other at a predetermined distance in a vertical view of the plasma display, at least one of said upper and lower surfaces of said diaphragm being coated with a dielectric layer consisting of at least one member selected from the group consisting of a glass and an inorganic dielectric material containing a glass, a minimum pitch of an arrangement of said apertures being less than 0.4 mm, a numerical aperture ratio of said apertures is a display area being more than 35% exclusive of said frame, and said apertures being filled with an ionizable gas.

2. The plasma display panel according to claim 1, wherein said metallic sheet contains at least one metal selected from the group consisting of iron, nickel, chromium and cobalt, and has a coefficient of linear expansion of $40\times10^{-7}$/° C. to $100\times10^{-7}$/° C. at 25 to 500° C.

3. The plasma display panel according to claim 1, wherein said glass in said dielectric layer has a softening point of 350 to 1000° C.

4. The plasma display panel according to claim 1, wherein said dielectric layer has a thickness of 2 to 40 μm.

5. The plasma display panel according to claim 1, wherein said diaphragm is used as a discharge electrode in addition to said first and second groups of a parallel electrodes.

6. The plasma display panel according to claim 1, wherein said metallic sheet comprises a plurality of stacked metal sheets having apertures overlapped on the same position.

7. The plasma display panel according to claim 1, wherein said apertures have an inner surface and a fluorescent material is deposited on said inner surface of said apertures.

* * * * *